US009054452B2

(12) United States Patent
Yamada

(10) Patent No.: US 9,054,452 B2
(45) Date of Patent: Jun. 9, 2015

(54) ELECTRICAL CONNECTOR ASSEMBLED COMPONENT

(71) Applicant: Hirose Electric Co., Ltd., Tokyo (JP)

(72) Inventor: Yoshihisa Yamada, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 22 days.

(21) Appl. No.: 14/016,684

(22) Filed: Sep. 3, 2013

(65) Prior Publication Data

US 2014/0065872 A1 Mar. 6, 2014

(30) Foreign Application Priority Data

Sep. 6, 2012 (JP) ..... 2012-195942

(51) Int. Cl.
*H01R 13/627* (2006.01)
*H01R 13/625* (2006.01)

(52) U.S. Cl.
CPC ..... *H01R 13/6271* (2013.01); *H01R 13/625* (2013.01)

(58) Field of Classification Search
CPC ..... H01R 13/6275; H01R 13/6272; H01R 13/6273
USPC ..... 439/357, 358
See application file for complete search history.

(56) References Cited

U.S. PATENT DOCUMENTS

| | | | | |
|---|---|---|---|---|
| 5,662,488 | A | 9/1997 | Alden | |
| 7,503,794 | B2 * | 3/2009 | Haller | 439/357 |
| 7,628,632 | B2 | 12/2009 | Holland | |
| 2010/0279536 | A1 * | 11/2010 | Paulus | 439/357 |

FOREIGN PATENT DOCUMENTS

| | | | |
|---|---|---|---|
| EP | 0971456 | A2 | 1/2000 |
| EP | 1077510 | A2 | 2/2001 |
| JP | S59-53780 | U | 4/1984 |
| JP | 2002-319453 | A | 10/2002 |
| JP | 2011-519135 | A | 6/2011 |
| JP | 4711808 | B | 6/2011 |
| JP | 2011-238403 | A | 11/2011 |

OTHER PUBLICATIONS

European Serch Report for EP 2706622 A3 (EP Application No. 13004277.3), Oct. 1, 2014.

* cited by examiner

*Primary Examiner* — Gary Paumen
(74) *Attorney, Agent, or Firm* — Kubotera & Associates, LLC

(57) ABSTRACT

An electrical connector assembled component includes a first connector and a second connector, which can fit and separate to/from each other along an axis. The first connector includes a first housing, and the second connector has a second housing. The first housing has a flexible section formed with a slit groove that penetrates in the radial direction in the fitting tube, and the flexible section has a locking section that protrudes inward in the radial direction from the cylindrical fitting surface. The second housing includes a locked section, in which there is formed an engaging step-like section that contacts with the locking section in the fitting process so as to elastically flex and displace the locking section to allow movement in the fitting direction to the locking position and locks with the locking section in the connector-removal direction.

10 Claims, 7 Drawing Sheets

ELECTRICAL CONNECTOR ASSEMBLED COMPONENT

BACKGROUND OF THE INVENTION AND RELATED ART STATEMENT

The present invention relates to an electrical connector assembled component. Especially, the present invention relates to an electrical connector assembled component having a lock mechanism to lock upon connector fitting and to release the lock mechanism.

Patent Reference has disclosed a conventional electrical connector assembled component. According to the electrical connector assembled component disclosed in Patent Reference, a first connector and a second connector, each of which has a fitting tube section, fit and lock to each other in an axial direction. Once the first connector and the second connector rotate along the circumferential directions relative to each other, the locking is released.

Patent Reference: Japanese Patent Publication No. 4,711,808

According to the electrical connector assembled component disclosed in Patent Reference, on an inner circumferential surface of the fitting tube section of the first connector and on an outer circumferential surface of the fitting tube section of the second connector, there is respectively formed a cylindrical fitting surface. The first connector has a protruding locking section at two positions, which protrude from the cylindrical fitting surface directing radially inward. The second connector has a flexible arm (first elastic piece) that extends in the axial direction and can elastically flex in the radial direction, and has protrusion-like sections to be locked on an outer surface in the radial direction of the flexible arm.

According to the conventional electrical connector assembled component, upon fitting the first connector to the second connector, the locking sections contact with the sections to be locked. Furthermore, the locking sections flex the flexible arm, on which the sections to be locked are formed, in the radial direction to move to the locking positions. Once the locking sections move over the sections to be locked and reach the locking positions, the locking of the flexible arm is released and recovers the original shape, and thereby the locking sections and the sections to be locked lock each other in a connector removal direction.

According to the conventional electrical connector assembled component, the second connector also has an arc-shaped flexible arm (second elastic piece) that is provided adjacent to the flexible arm and extends in the circumferential direction. The arc-shaped flexible arm has a protrusion away from the flexible arm in the circumferential direction. Moreover, at a position before the protrusion in the circumferential direction, there is formed a groove along the axial direction for releasing the lock, extending along the axial direction.

Accordingly, upon release of the lock, by rotating the first connector relative to the second connector in a direction that the arc-shaped flexible arm extends, the locking sections move over the protrusion while flexing the arc-shaped flexible arm with the protrusion of the arc-shaped flexible arm, so as to be positioned within the groove provided along the axial direction. Being in the state, if the first connector is pulled in the removal direction, the locking section of the first connector moves in the axially-extending groove in the axial direction and the first connector is pulled out therefrom.

However, according to the conventional electrical connector assembled component disclosed in Patent Reference, the connector has to have a complicated configuration, which results in poor strength. Moreover, there is another issue of high manufacturing cost due to the dies and complicated molding step thereof.

According to the electrical connector assembled component disclosed in Patent Reference, the second connector has a locking flexible arm that extends in an axial direction as well as an arc-shaped flexible arm to release the locking. In addition, there is formed an axially-extending groove for guiding the locking section in the connector removal direction to release the locking, which extends in the circumferential direction. Separately having the arc-shaped flexible arm to release the locking, which extends in the circumferential direction in addition to the flexible arm for locking, the amount of flexible portions increase and the configuration is complicated, which results in the above-described problems. Moreover, in the circumferential direction, the arc-shaped flexible arm takes a large space, so that it is difficult to provide in other area, which means less flexibility in designing.

In view of the above-described problems of conventional connectors, an object of the invention is to provide an electrical connector assembled component that has a simple configuration and high strength, and includes a mechanism that can be produced inexpensively and is capable of locking and unlocking the connector fitting.

Further objects and advantages of the invention will be apparent from the following description of the invention.

SUMMARY OF THE INVENTION

In order to attain the above object, according to a first aspect of the invention, an electrical connector assembled component includes a first connector and a second connector, which can fit and separate to/from each other along an axis. The first connector includes a first housing, in which a cylindrical fitting surface having the axis as the center on a fitting tube. The second connector has a second housing, in which a cylindrical fitting surface having the axis as the center on a fitting tube. Upon fitting, the first connector and the second connector are locked in the connector removal direction upon completion of connector fitting, and by relatively rotating around the axis, the lock can be released.

According to the electrical connector assembled component, the first housing has a flexible section formed with a slit groove that penetrates in the radial direction in the fitting tube, and the flexible section has a locking section that protrudes inward in the radial direction from the cylindrical fitting surface. The second housing includes a locked section, in which there is formed an engaging step-like section that contacts with the locking section in the fitting process so as to elastically flex and displace the locking section to allow movement in the fitting direction to the locking position and locks with the locking section in the connector-removal direction. Rotating the first housing and the second housing relative to each other in the circumferential direction around the axis, the locking section elastically flexes and displace outward in the radial direction so as to bring onto a cylindrical fitting surface of the second housing to release the locking.

According to the electrical connector assembled component, during locking by the connector fitting, once it reaches the locked section of the second connector, which is a locking position, after the flexible section of the first connector elastically flexes, reducing the elastic flex, it locks with the engaging step-like section in the connector-removal direction. Upon releasing the locking, the first connector is rotated relative to the second connector to move in the circumferential direction. The locking section moves in the circumferential direction and receives elastic counterforce from the side edge of the locked section to elastically flex outward in the radial direction, comes off from the range of the locked section, becomes placed on the cylindrical fitting surface of the second connector, and becomes in the lock-released state.

Therefore, pulling at this position the first connector in the axial direction, it is possible to remove the first connector. According to the electrical connector assembled component, the first connector has a flexible section equipped with a locking section, so that, without having a flexible section of the locked section of the second connector, it is possible to release the locking only by rotating to move the locking section of the first connector in the circumferential direction. Accordingly, the second connector can have very simple configuration and takes less space, and thereby it is possible to attain downsizing, cost reduction, and improved strength of the connector.

According to a second aspect of the invention, in the electrical connector assembled component, the flexible section of the first housing can be configured such that the flexible section is shaped with a slit groove that extend in a V-shape having its apex on the fitting side. According to the configuration, since the flexible section may be shaped with the V-shaped slit groove, a basal section thereof has a large width in the circumferential direction and has high strength. In addition, since the slit groove is formed penetrating the fitting tube section of the first housing of the first connector in the radial direction, it is easy to visually check a position of the slit groove from radially outside. Accordingly, although it may be difficult to see the locking section itself provided inside in the radial direction, it is possible to easily position the locking section in the circumferential direction so as to correspond to the locked section of the second connector.

According to a third aspect of the invention, in the electrical connector assembled component, the slit groove includes a V-shaped slit groove and another V-shaped slit groove provided inside with an interval from the V-shape slit groove, and a V-shaped strip-like flexible section is formed between the slit grooves. With this configuration, since there is formed the V-shaped strip-like flexible section between the one slit groove and the other slit groove, the flexible section is formed like a fixed beam. Therefore, it is possible to increase the arm length without increasing the dimension in the axial direction and it is possible to secure large elastic flexure.

According to a fourth aspect of the invention, in the electrical connector assembled component, the locked section of the second housing may be configured such that a wall surface, which is a part of a concaved circumferential wall section formed in the fitting cylindrical section being depressed from the cylindrical fitting surface of the second housing and is the one provided on the fitting side, forms an engaging step-like section that contacts with the locking section. The locked section may be formed as a concave section that is depressed from the cylindrical fitting surface and has a simple shape. Moreover, with a wall surface that is a part of the circumferential surface of the concave section and on the fitting side, it may be possible to form the engaging step-like section, so that it is possible to attain high strength with the simple shape.

According to a fifth aspect of the invention, in the electrical connector assembled component, it is possible to configure the concave section such that at least one of sidewall surfaces thereof provided on both ends in the circumferential direction is formed as a slanted side surface that slantingly rises towards the cylindrical fitting surface from the concave-section's bottom surface, and the slanted side surface guides the locking section in the circumferential direction upon release of the lock so as to enable rotational operation of the first connector in the circumferential direction. With this configuration, it is possible to guide the locking section in the circumferential direction with the slanted side surface that rises at the sidewall surface of the concave section from a bottom surface to the cylindrical fitting surface, and the guiding configuration can have a simple shape and small size as well as high strength. Furthermore, with surfaces of the both sidewalls are formed as slanted side surfaces, it is possible to release the lock by rotating the first connector in either direction.

According to a sixth aspect of the invention, in the electrical connector assembled component, among side surfaces of the locking section provided on the both sides in the circumferential direction, at least one side surface thereof can be formed as a slanted side surface that narrows the width between the side surfaces thereof towards the protruding end of the locking section so as to have the slanted side surface guided by the sidewall of the concave section and thereby enable rotational operation of the first connector in the circumferential direction upon release of the lock. With this configuration, when it is difficult to form a slanted side surface on the concave section of the second connector, it is possible to obtain similar lock-releasing mechanism to the one obtained by a slanted side surface provided on the concave section by providing a slanted side surface on the locking section of the first connector.

According to the sixth aspect of the invention, in the electrical connector assembled component, the locked section may be configured so as to have a slanted surface for guiding the locking section towards the apex of the locked section in the fitting process. With this configuration, it is possible to guide the locking section to the apex of the locked section with the guiding slanted surface and further move the locking section over the apex to bring it to the locking position.

According to a seventh aspect of the invention, in the electrical connector assembled component, the second connector preferably includes a guiding groove for guiding the locking section of the first housing towards the locked section in the fitting process. The guiding groove is formed on an outer circumferential surface of the fitting tube section so as to extend in the axial direction from the end section in the fitting direction to the locked section. With this configuration, the guiding groove can guide the locking section to the locked section.

According to an eighth aspect of the invention, in the electrical connector assembled component, the guiding groove is preferably formed such that a groove width in the circumferential direction is large at an end in the fitting direction and becomes smaller towards the locked section. With this configuration, providing the locking section within wide area of the guiding groove upon beginning of the fitting, as the fitting progresses, the locking section moves to a regular position in the circumferential direction and is guided to the locked section.

As described above, in the electrical connector assembled component a flexible section equipped with a locking section is formed by a slit groove formed in the first housing of the first connector, and an engaging step-like section is formed as a locked section in the second housing of the second connector. Therefore, there is no need to provide a flexible section in the second connector as in the conventional connector of Patent Reference. Furthermore, since it is configured to unlock by guiding the locking section from the locking position to the cylindrical fitting surface in the circumferential direction, the locking section can easily move to the fitting cylindrical surface by rotation of the first connector and the connector can be easily detached. Therefore, the second connector can have a lock-release configuration that is very simple, small, and highly strong. With such small-sized second connector, it is also possible to attain a small-sized electrical connector assembled component.

DESCRIPTION OF THE PREFERRED EMBODIMENTS

Hereunder, referring to the accompanying drawings, embodiments of the invention will be described.

Figure 1:
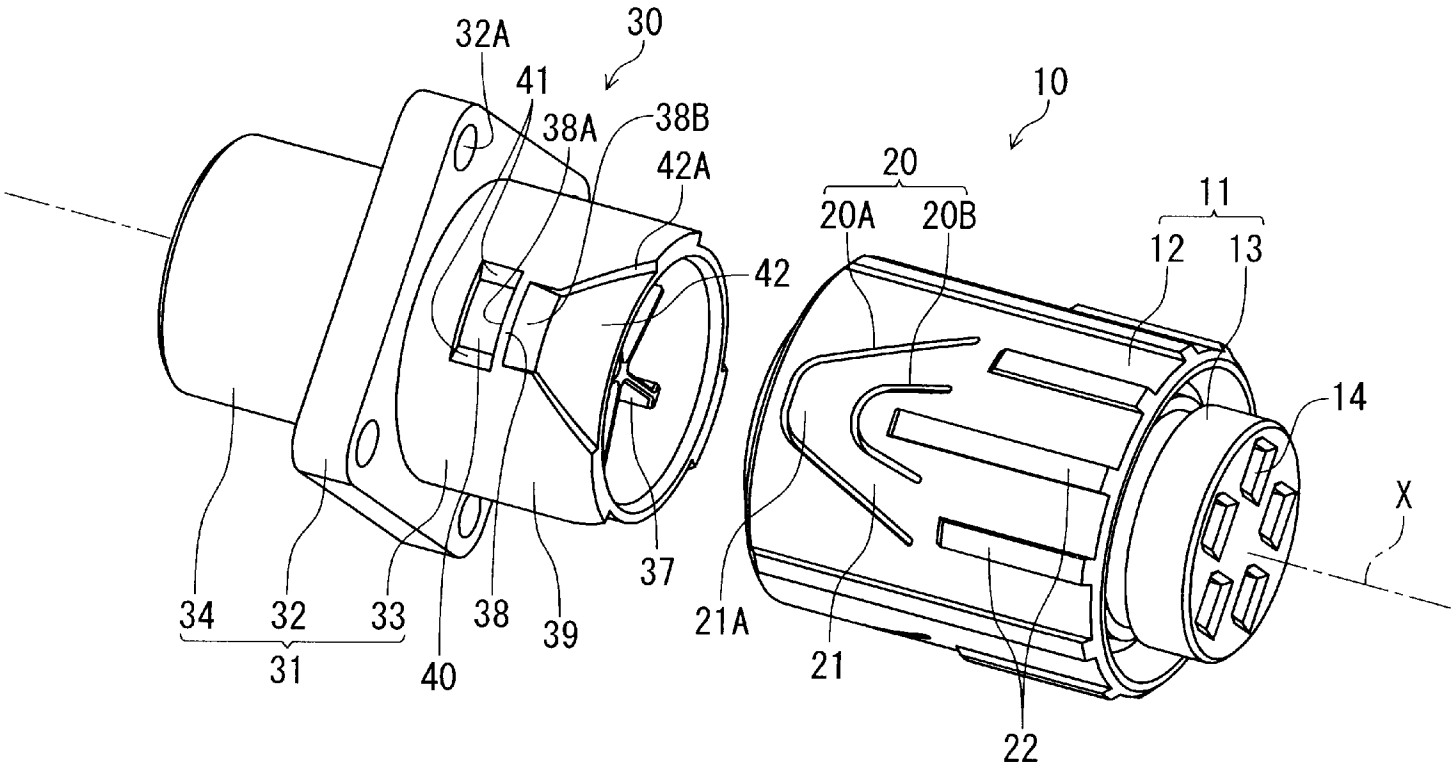
FIG. 1 is a perspective view showing an electrical connector assembled component composed of a first connector and a second connector in a state before the first connector is fitted to the second connector according to an embodiment of the present invention.
Figure 3:
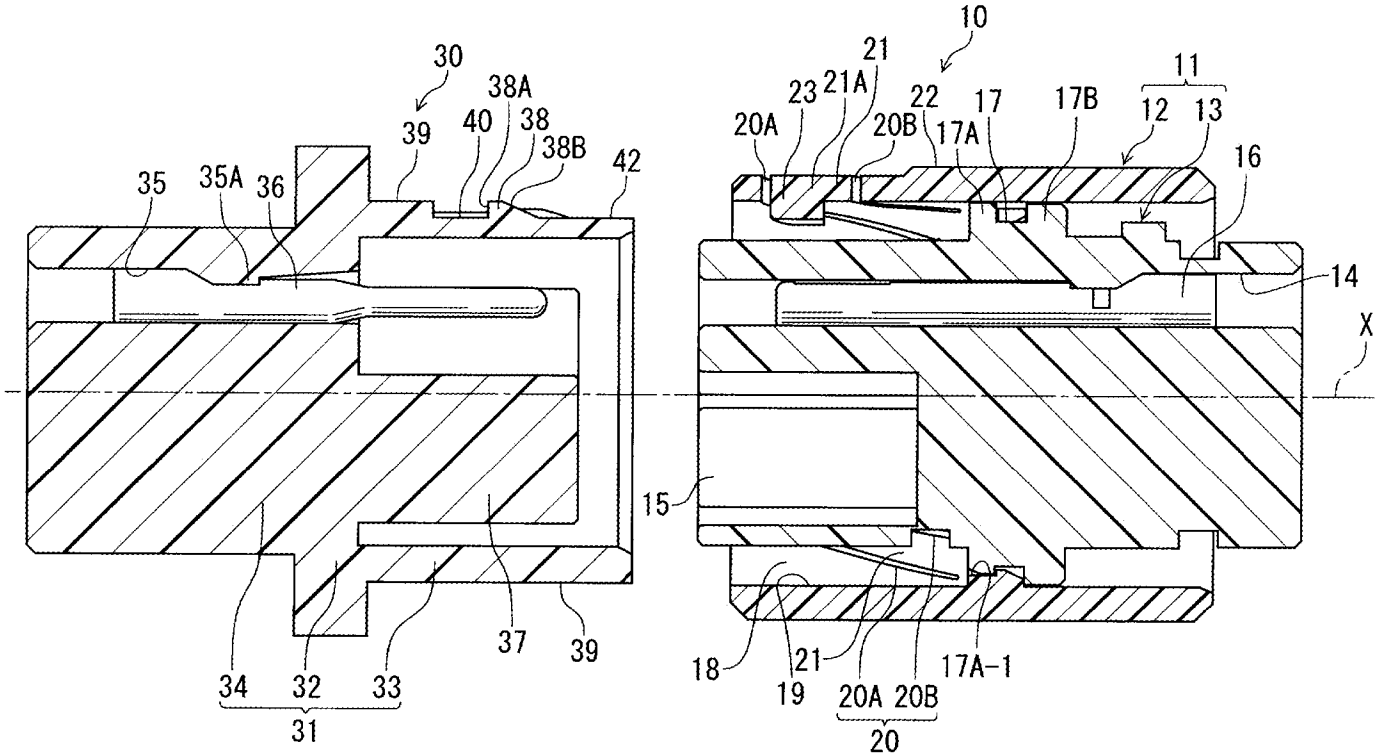
FIG. 3 is a sectional view showing the connector assembled component in a state before the first connector is fitted to the second connector according to the embodiment of the present invention.

According to the embodiment, a first connector 10 formed as a plug connector and a second connector 30 formed as a receptacle connector compose a connector assembled component, being fitted to each other as shown in perspective view of FIG. 1 and a sectional view of FIG. 3.

Figure 2:
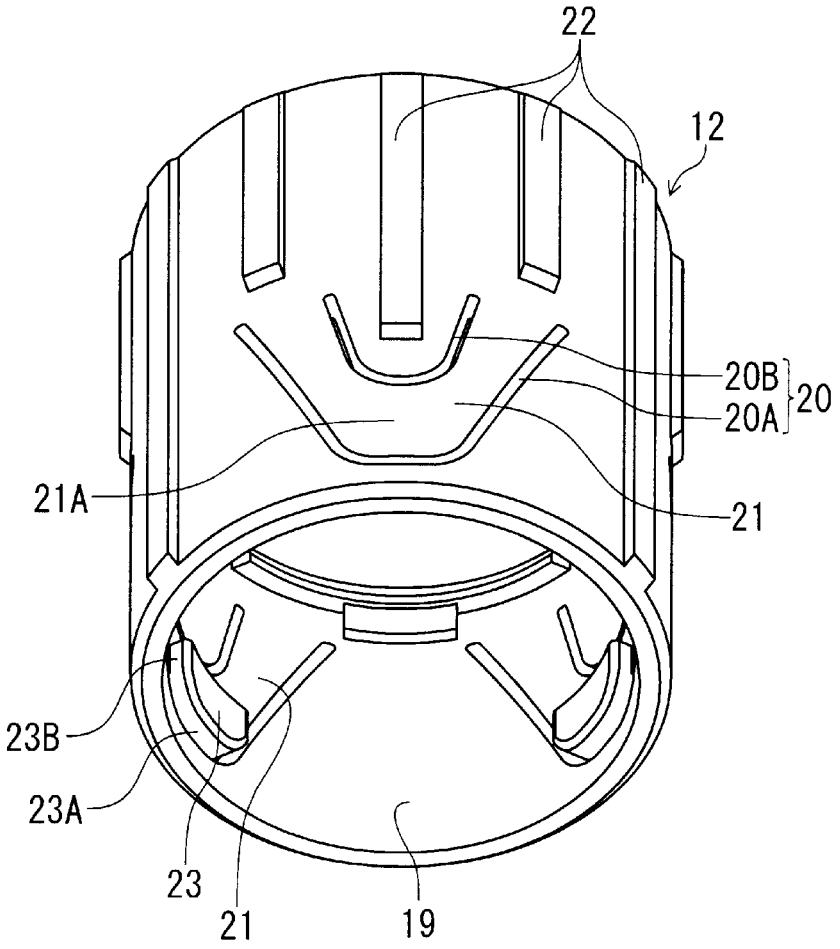
FIG. 2 is a perspective view showing an outer housing of the first connector of the electrical connector assembled component viewed from a fitting side thereof according to the embodiment of the present invention.

According to the embodiment, the first connector 10 includes a housing 11 made of an electrically insulating material (hereinafter the housing of the first connector 10 is referred to as a "first housing" and a housing of the second housing 30 is referred to as a "second housing" for clarification between housings of the first connector 10 and the second connector 30). The housing 11 is composed of a sleeve-like outer housing 12 and a column-like inner housing 13 provided inside the outer housing 12. The outer housing 12 is attached so as to be capable of rotating relative to the inner housing 13 in the circumferential direction around an axis X. FIG. 2 is a perspective view showing only the outer housing 12.

According to the embodiment, as also shown in FIG. 3, in the inner housing 13, there is provided a plurality of terminal-holding holes 14 that penetrate in a direction of the axis X and there is also formed a radial slit section 15 that is opened on the fitting side thereof ("the fitting side" of the first connector and the second connector means a side of each connector that faces the mating connector) extends radially around a position of the axis X and in the direction of axis X. In each terminal-holding hole 14, a terminal 16 is held therein being pressed towards the fitting side. Each terminal 16 has a groove section to receive a pin-like terminal of the second connector 30 at one end that is on the fitting side, and to connect to a cable at the other end that is on the other side. Since the terminal 16 itself is not an aspect of the invention, further explanation is omitted. On an outer circumferential surface of the inner housing 13, there is provided an annular groove 17 for connecting with the outer housing 12, which will be described later, which is formed by two annular protrusions 17A and 17B that are adjacent to each other in the direction of axis X. On one annular protrusion 17A, there is formed a cut-out section 17A having less protrusion in the radial direction at a plurality of points in the circumferential direction.

According to the embodiment, in the first housing 11, the sleeve-like outer housing 12 forms a fitting tube section for positioning on the outer circumferential surface of the second connector 30 upon connector fitting. The outer housing 12 forms an annular receiving space 18 with the inner housing 13, which extends in the axial direction from an end in the fitting direction to a position of the annular protrusion 17A. Therefore, an inner circumferential surface of the outer housing 12, which forms the annular receiving space 18, forms a cylindrical fitting surface 19 for the second connector 30. On the outer housing 12, there are formed generally V-shaped slit grooves 20, which penetrate the outer housing 12 on the cylindrical fitting surface in the radial direction, at a plurality of points (three points in the illustrated example) in the circumferential direction (especially see FIGS. 1 and 2). According to the embodiment, each slit groove 20 is tapered with an apex of the V-shape directs the fitting side thereof, and includes a primary slit groove 20A and an auxiliary slit groove 20B that is provided in an area surrounded by the primary slit groove 20A, forming a V-shaped strip-like flexible section 21 between the primary slit groove 20A and the auxiliary slit groove 20B. Accordingly, the flexible section 21 is formed as a fixed beam that extends towards the fitting side of the outer housing 12 from both basal ends of the V-shape, with its center part 21A positioned most closely to the end of the outer housing 12 in the fitting direction. Therefore, the fixed beam-like flexible section 21 can elastically flex relative to the cylindrical fitting surface 19 in the radial direction, and has the maximum flexure at the center part 21A.

As shown in FIG. 1 as well as FIG. 2, on the outer circumferential surface of the outer housing 12, there are provided reinforcing thin protrusions 22 extending in the direction of the axis X at a plurality of positions in the circumferential direction on the opposite side to the flexible section 21 in the axial direction. Among those reinforcing thin protrusions 22, the reinforcing thin protrusions 22 provided between the flexible sections 21 in the circumferential direction extends between the flexible sections 21 to reach the edge of the outer housing 12 in the fitting direction.

According to the embodiment, at the center part 21A of each flexible section 21, there is provided a locking section 23 that protrudes inward in the radial direction in relative to the cylindrical fitting surface, the inner side of the outer housing 12. As for a wall surface of each locking section 23, both the front wall surface 23A provided on the fitting side of the outer housing 12 and side surfaces 23B provided in the circumferential direction are continuously formed to have a U-shaped outer surface with slight roundness at U-shape's bottom corners formed by the both side surfaces 23B.

As shown in FIG. 1, the second connector 30 includes a second housing 31 made of an electrically insulating material and terminals 36. The second housing 31 includes a mounting flange 32 with mounting screw holes 32A; which projects outward in the radial direction; a cylindrical fitting tube 33 provided on a fitting side of the second connector so as to extend from the mounting flange 32; and a terminal holding section 34 having a cylindrical outer circumferential surface on a side opposite the fitting side. In the terminal holding section 34, corresponding to the terminals 16 of the first connector 10 in the circumferential direction and the radial direction, there are provided terminal holding holes 35 extending in the direction of the axis X for terminals 36 to be pressed and held therein, engaging with an engaging protrusion 35A formed on an inner surface of the fitting tube section 33. Each terminal 36 has a pin-like shaped end held in the fitting tube section 33, so as to enter a groove-like part of the terminal 16 of the first connector 10 to electrically connect thereto. Herein, since the terminal 36 is not an aspect of the invention, further explanation is omitted.

According to the embodiment, in the fitting tube section 33 of the second housing 31, there is provided a radial wall member 37 so as to divide between the terminals 36 provided corresponding to the terminals 16 of the first connector 10. The radial wall member 37 is formed such that wall plates extending in the radial direction around the axis X and in the direction of the axis X are radially connected. The fitting tube section 33 has on its outer circumferential surface a cylindrical fitting surface 39, correspondingly so as to fit to the cylindrical fitting surface 19 formed on the inner circumferential surface of the outer housing 12 of the first connector 10.

As shown in FIG. 1, corresponding to the locking sections 23 formed on the flexible sections 21 of the first housing, the second housing 31 has sections to be locked 38 that engage with the locking sections in the direction of the axis X. Each locked section 38 has an engaging step-like section 38A formed by a wall surface that is a fitting-side part of a circumferential wall of a concave section 40, which is formed being depressed from the cylindrical fitting surface 39 formed on the fitting tube section 33 of the second housing 31.

In other words, the wall surface is provided being perpendicular to the cylindrical fitting surface 39 to form the step-like shape on the bottom surface side of the concave section 40, and thereby forms an engaging step-like section 38A that engages with the locking section 23 of the first connector 10 in the connector removal direction.

According to the embodiment, the locked section 38 has a fitting-guide slanted surface 38B on the open edge side of the fitting tube section 33 relative to the engaging step-like section 38A within the circumferential area of the engaging step-like section 38A, being adjacent to the engaging step-like section 38A.

In other words, the locked section 38 has a certain thickness equivalent to the width between the engaging step-like section 38A and the fitting guide slated surface 38B to be against the locking force. On a sidewall surface provided on both sides in the circumferential direction of the concave section 40, there are formed slanted side surfaces 41 that extend from the bottom surface of the concave section 40 with slant. Each slanted side surface 41 is configured to guide in the circumferential direction the locking section 23 that is in locking position within the concave section 40 as the first connector 10 is rotated in the circumferential direction, so as to bring to a position on the side of the concave section 40 on the cylindrical fitting surface 39, which is to be a lock-releasable position. With the slanted side surfaces 41 provided on both sides in the circumferential direction of the concave section 40, it is possible to rotate the first connector in either direction of the circumferential direction (clockwise or counterclockwise) for releasing the lock.

According to the embodiment, on the fitting side relative to the concave section 40, there are formed guide grooves 42 for guiding the locking sections 23 of the first connector 10 to corresponding positions in the circumferential direction during the connector fitting process. Each guide groove 42 is formed being depressed relative to the cylindrical fitting surface 39, and has its width and position in the circumferential direction so as to correspond to the fitting guide slanted surface 38B at a part adjacent to the concave section 40 in the direction of the axis X and continues to the fitting guide slanted surface 38B in the direction of the axis X. At the opening end of the fitting tube section 33, each guide groove 42 has a larger dimension than the width at the part near the concave section 40, and has slanted side edges 42A forming a generally V-shape when viewed in the radial direction. Accordingly, when the locking sections 23 are in the circumferential area of the guide grooves 42, the locking sections 23 reach the fitting guide slanted surfaces 38B being guided by the slanted side edges 42A of the guide grooves 42 in the connector fitting process.

According to the embodiment, the first connector 10 and the second connector 30 may be used as a connector assembled component as will be described below.

First, the second connector 30 is brought in position contacting to a member of a panel of an electronic device or the like (not illustrated) with the mounting flange 32 attached, and then suitably attached thereto at the mounting screw holes 32A with screw members. The terminal holding sections 34 of the second connector 30 are provided in the electronic device, and the terminals 36 thereof are connected to a corresponding circuit of the electronic device or the like via a cable (not illustrated). Therefore, the second connector 30 is provided with the fitting tube section 33 that protrudes from a panel's outer surface of the electronic device.

On the other hand, in the first connector 10, the terminal holding holes 14 hold the terminals 16 that are crimped to connect to a cable (not illustrated). Accordingly, from the first connector 10, the cable extends outside from the rear side thereof in the connector fitting direction.

According to the embodiment, the first connector 10 is used by fitting and connecting to the second connector that is already attached to a panel of an electronic device or pulling off therefrom.

According to the embodiment, upon fitting and connecting to the second connector 30, confirming the slit grooves 20 formed on the outer circumferential surface of the first connector 10 and checking the circumferential positions so as to position the flexible sections 21 within the range of the guide grooves 42 of the second connector 30, the first connector 10 is fitted to the second connector 30 by pressing along the axis X so as to have the fitting tube section 33 of the second connector enter the annular receiving space 18 formed between the outer housing 12, and the inner housing 13, i.e. the fitting tube.

According to the embodiment, since the flexible sections 21 of the first connector 10 are provided in the range of the guide grooves 42 of the second connector 30, the locking sections 23 provided to protrude inward in the radial direction of the flexible section 21 are positioned in the range of the guide grooves 42. Therefore, with the first connector 10 is pressed to the second connector 30 to put therein, connection between the terminals 16 of the first connector 10 and the terminals 36 of the second connector 30 are tightened, and at the same time, the locking sections 23 of the first connector 10 reach the fitting guide slanted surface 38B positioned in a part near the concave section 40 in the guide grooves 42 of the second connector 30. Upon beginning of the fitting procedure, even when the locking sections 23 are not within the range of the fitting guide slanted surface 38B in the circumferential direction, the locking sections 23 can reach position of the fitting guide slanted surface 38B with the progress of the fitting being guided by the slanted side edge 42B of the guide groove 42, as long as within the range of the guide grooves 42.

According to the embodiment, as the first connector 10 to the second connector 30 is further fitted even after the locking section 23 reached the fitting guide slanted surface 38B, the locking sections 23 receive counterforce outward in the radial direction from the fitting guide slanted surfaces 38B, the flexible sections 21 generate elastic flexure in the direction, the locking sections 23 move along the fitting guide slanted surfaces 38B, and reach the concave sections 40. Once the locking sections 23 are placed in the concave sections 40, the elastic flexure of the flexible sections 21 decreases, and the locking sections 23 are in state that the engaging step-like sections 38A of the locking sections 23 can engage thereto in the connector removal direction.

Figure 4:
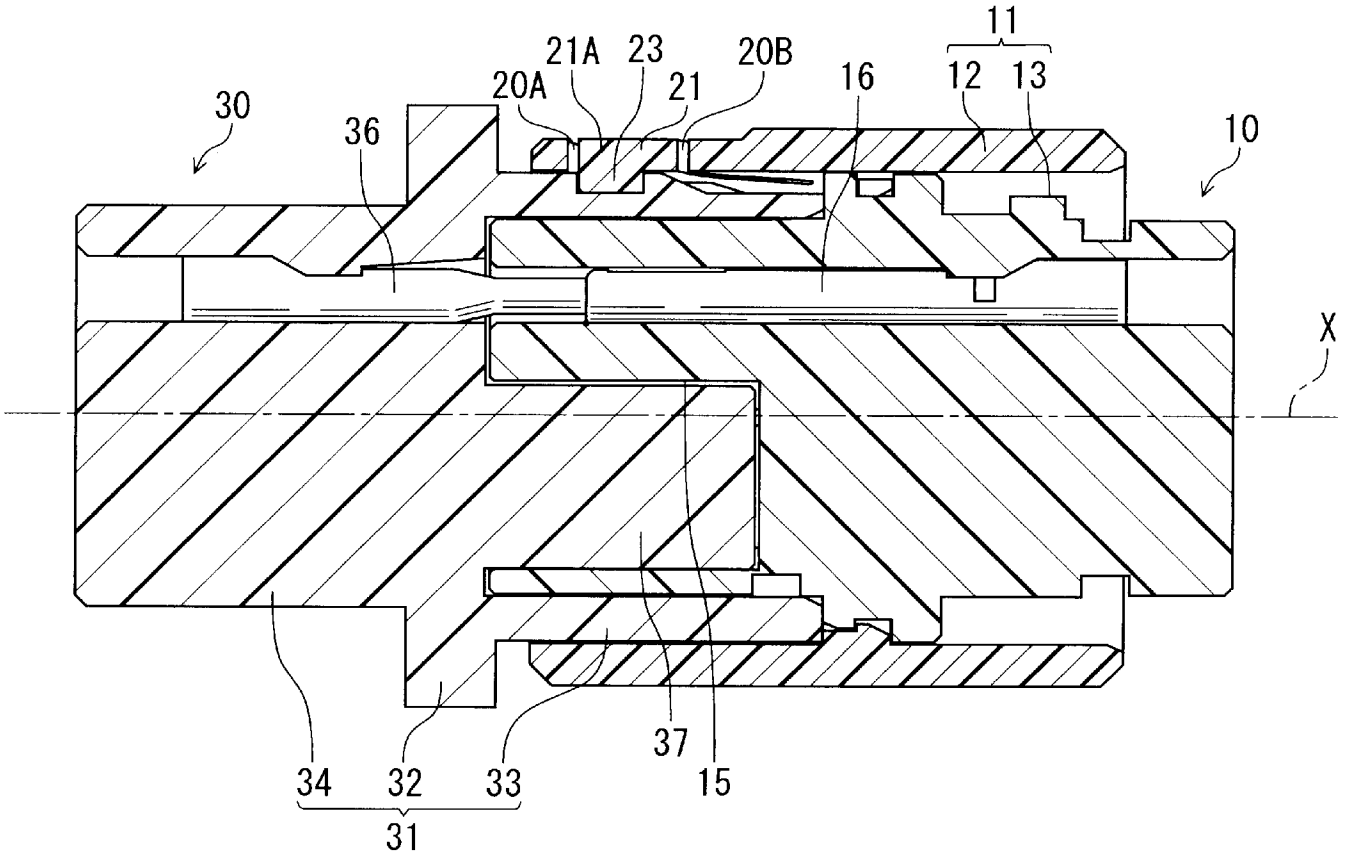
FIG. 4 is a sectional view showing the connector assembled component after the first connector is fitted to the second connector according to the embodiment of the present invention.

With this procedure, the connector fitting can be completed as shown in FIG. 4. Therefore, after completion of the connector fitting, even when the first connector 10 is unexpectedly pulled, because of contact with the engaging step-like sections 38A at the locking sections 23, the first connector 10 is prevented from coming off therefrom. When the locking sections 23 are in the concave sections 40, the first connector 10 and the second connector 30 are in specified positions in the fitting state, so that the terminals 16 of the first connector 10 and the terminals 36 of the second connector 30 are in connected state with a certain connection length. The terminals 16 and the terminals 36 are connected at a plurality of positions in the circumferential direction with their respective terminals, and the terminals 16 and the terminals 36 at the respective positions are separated being divided with radial wall member 37 of the second connector that entered the radial slit section 15 of the first connector 10. As described above, the fitting procedure may be completed by simply pressing the first connector 10 to the second connector 30 along the axis X.

Next, upon removing the first connector 10 from the second connector 30, the first connector 10 is first rotated relative to the second connector 30 in the circumferential direction to bring to the lock-release position, and then pulled out in the removal direction.

Figure 5:
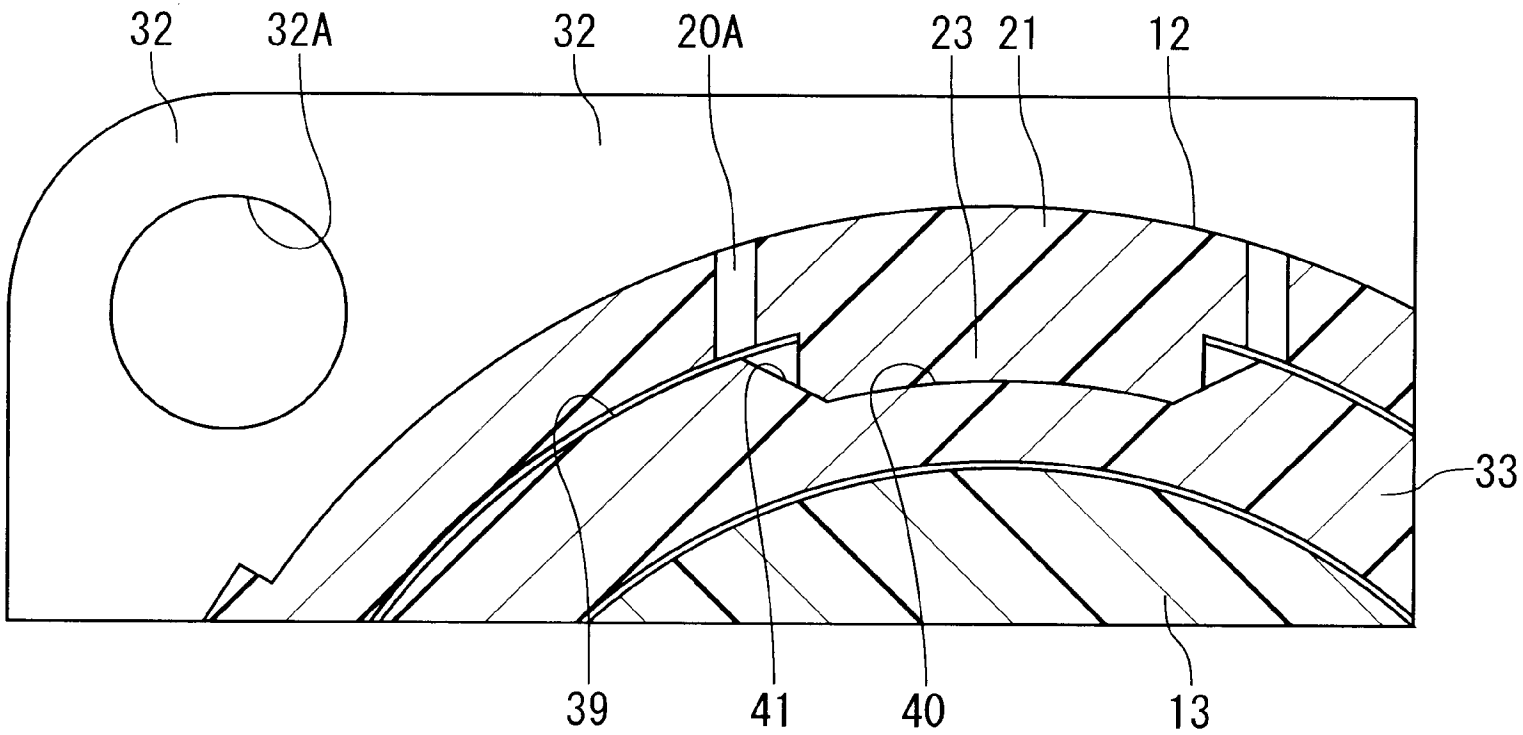
FIG. 5 is an enlarged sectional view showing a locking section of the first connector and a locked section of the second connector of the connector assembled component taken along a direction orthogonal to an axial direction thereof in a state after the locking section locks the locked section according to the embodiment of the present invention.
Figure 6:
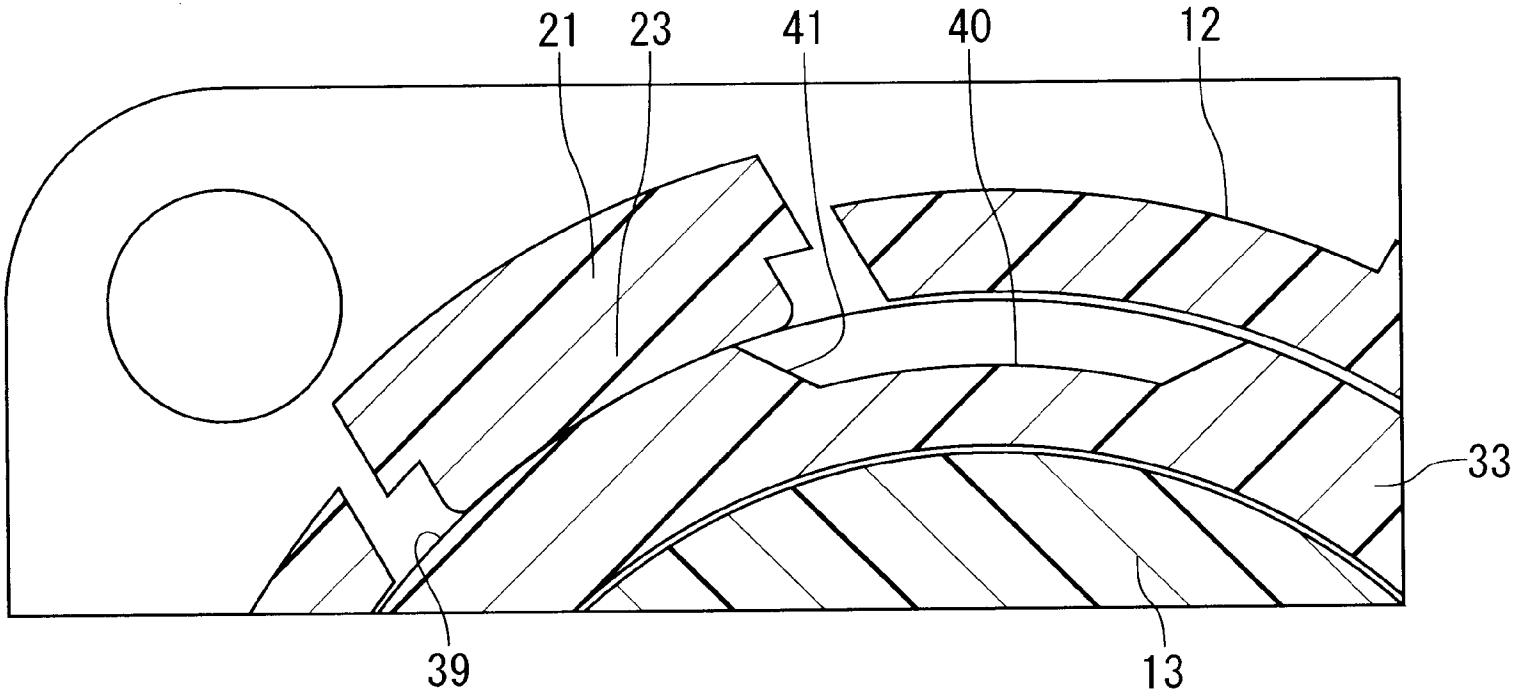
FIG. 6 is a perspective view showing the locking section and the locked section of the connector assembled component in a state after the locking section is released from the locked section according to the embodiment of the present invention.

According to the embodiment, when the first connector 10 is rotated in one of circumferential directions, the locking sections 21 move in the circumferential direction towards the slanted side surfaces 41 from the bottom surfaces of the concave sections 40 (see FIG. 5), and once reach the slanted side surfaces 41 by the movement, the locking sections 23 receive counterforce from the slanted side surfaces 41 and the flexible sections 21 generate elastic flexure outward in the radial direction, and thereby the locking sections 23 further move in the circumferential direction while moving up the slanted side surface 41 (see FIG. 6), and reach the position of the cylindrical fitting surfaces 39 outside the concave sections 40.

When the first connector 10 is pulled in the removal direction while being in the position, the locking sections 23 move on the cylindrical fitting surface 39 while sliding in the direction of the axis X and the connector removal is completed. In case the locking sections 23 are pulled out in the axial direction at a position slightly off from the concave sections 40 in the circumferential direction, the locking sections 23 could slide back in the guide grooves 42, but even in this case, the locking sections 23 can still move in the removal direction sliding the groove bottom surfaces of the guide grooves 42, and there is no problem in the connector removal. As described above, the connector removal procedure may be completed by pulling the connector 10 along the axis X after rotating the first connector relative to the second connector 30 in either circumferential direction (clockwise or counterclockwise).

Here, the embodiment may be modified or altered. For example, the flexible sections 21 formed in the first housing 11 of the first connector 10 may not have to be formed by the two V-shaped slit grooves, but may be formed with one V-shaped slit groove instead.

Figure 7:
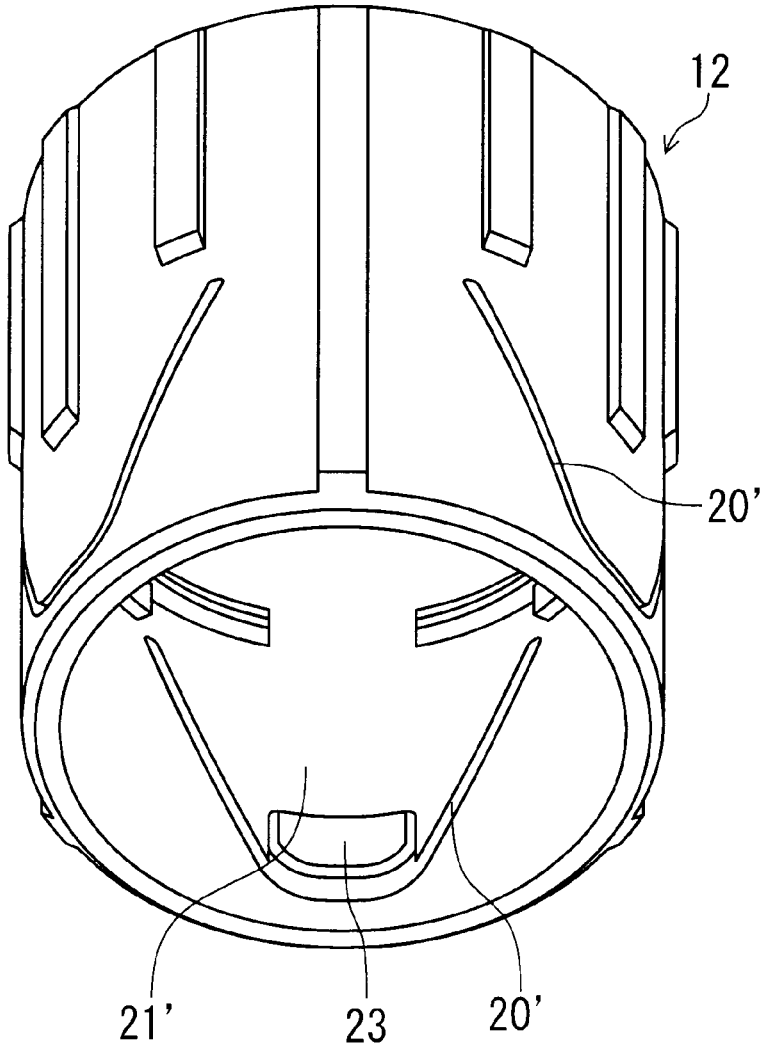
FIG. 7 is a perspective view showing a modified example of the first housing of the first connector of the connector assembled component according to the embodiment of the present invention.

In the example of FIG. 7, only slit groove 20' that is equivalent to the primary slit groove 20A of FIG. 1 is formed, and a part in the slit groove 20' that extends in the V-shape forms the flexible section 21'. Therefore, while the V-shaped strip-like flexible section 21 is formed as a fixed beam in the example of FIG. 1, the flexible section 21' is formed as a cantilever in the example of FIG. 7, so that the flexure may decrease but it is possible to improve the strength. Whether forming the flexible section as a cantilever or a fixed beam may be selected, according to conditions required by the connector upon locking and lock-release.

In the example of FIG. 1, each locking section 23 has roundness at lower ends of the side surfaces 23B, but the side surfaces 23B form a surface extending in radial direction of the first connector 10 as a whole, so that the locking sections 23 can move in the lock releasing direction being guided by the slanted side surfaces 41 of the concave sections 40, which are formed as sections to be locked in the second housing 31 of the second connector 30. On the other hand, in a modification example, it is possible to provide the slanted side surfaces in the locking sections. More specifically, side surfaces of each locking section may be formed as the slated surfaces so as to narrow the width (dimension in the circumferential direction) of the locking section towards the protruding direction of the locking direction (inward in the radial direction), and the side surfaces of each concave section 40 may be provided as surfaces perpendicular to the bottom surface of the concave section. Needless to say, the slanted side surfaces may be also formed both in the locking protrusions and the concave sections.

The disclosure of Japanese Patent Application No. 2012-195942 filed on Sep. 6, 2012, is incorporated in the application by reference.

While the invention has been explained with reference to the specific embodiments of the invention, the explanation is illustrative and the invention is limited only by the appended claims.

What is claimed is:

1. An electrical connector assembled component comprising:

a first connector including a first housing; and a second connector including a second housing and capable of fitting to the first connector in a fitting direction along an axial line thereof, wherein said first housing includes a slit groove and a flexible section formed with the slit groove, said flexible section including a locking section protruding inwardly in a radial direction of the first housing, said second housing includes a locked section, said locked section including an engaging section for contacting with the locking section so as to elastically deform the locking section in the radial direction when the first housing is rotated relative to the second housing, and said slit groove is formed in a V-character shape having an apex toward the fitting direction.

2. The electrical connector assembled component according to claim 1, wherein said slit groove includes a first V-character shape slit groove and a second V-character shape slit groove with a space in between so that the flexible section is formed between the first V-character shape slit groove and the second V-character shape slit.

3. The electrical connector assembled component according to claim 1, wherein said engaging section is formed in a step shape as a concave section recessed in an outer surface of the second housing.

4. The electrical connector assembled component according to claim 3, wherein said concave section includes a slanted side surface for guiding the locking section so that the locked section is released from the locking section.

5. The electrical connector assembled component according to claim 3, wherein said locking section includes a slanted side surface to be guided with the concave section so that the locked section is released from the locking section.

6. The electrical connector assembled component according to claim 1, wherein said locked section includes a slanted surface for guiding the locking section toward the locked section.

7. The electrical connector assembled component according to claim 1, wherein said second housing includes a guiding groove for guiding the locking section toward the locked section.

8. The electrical connector assembled component according to claim 7, wherein said guiding groove has a groove width decreasing toward the locked section.

9. An electrical connector assembled component comprising:

a first connector including a first housing; and a second connector including a second housing and capable of fitting to the first connector in a fitting direction along an axial line thereof, wherein said first housing includes a slit groove and a flexible section formed with the slit groove, said flexible section including a locking section protruding inwardly in a radial direction of the first housing, said second housing includes a locked section, said locked section including an engaging section for contacting with the locking section so as to elastically deform the locking section in the radial direction when the first housing is rotated relative to the second housing, and said slit groove includes a first V-character shape slit groove and a second V-character shape slit groove with a space in between so that the flexible section is formed between the first V-character shape slit groove and the second V-character shape slit.

10. An electrical connector assembled component comprising:

a first connector including a first housing; and a second connector including a second housing and capable of fitting to the first connector in a fitting direction along an axial line thereof, wherein said first housing includes a slit groove and a flexible section formed with the slit groove, said flexible section including a locking section protruding inwardly in a radial direction of the first housing, said second housing includes a locked section, said locked section including an engaging section for contacting with the locking section so as to elastically deform the locking section in the radial direction when the first housing is rotated relative to the second housing, said engaging section is formed in a step shape as a concave section recessed in an outer surface of the second housing, and said locking section includes a slanted side surface to be guided with the concave section so that the locked section is released from the locking section.

* * * * *